US005435252A

United States Patent [19]

Theurer et al.

[11] Patent Number: 5,435,252

[45] Date of Patent: Jul. 25, 1995

[54] MOBILE WORKING MACHINE FOR TREATMENT OF A BALLAST BED OR SUBGRADE

[75] Inventors: Josef Theurer, Vienna; Manfred Brunninger, Altenberg, both of Austria

[73] Assignee: die Firma Franz Plasser Bahnbaumaschinen - Industriegesellschaft m.b.H., Vienna, Austria

[21] Appl. No.: 223,594

[22] Filed: Apr. 6, 1994

[30] Foreign Application Priority Data

Apr. 8, 1993 [AT] Austria ..... 720/93

[51] Int. Cl.[6] ..... E01B 29/04

[52] U.S. Cl. ..... 104/7.1; 104/7.3

[58] Field of Search ..... 104/7.1, 7.2, 7.3

[56] References Cited

U.S. PATENT DOCUMENTS

| | | | |
|---|---|---|---|
| 2,737,901 | 3/1956 | Drouard et al. | 104/7.3 |
| 3,055,309 | 9/1962 | Moss | 104/7.3 |
| 3,179,002 | 4/1965 | Christoff | 104/7.3 |
| 4,064,807 | 12/1977 | Theurer | 104/7.3 |
| 4,479,439 | 10/1984 | Theurer et al. | 104/7.1 |

FOREIGN PATENT DOCUMENTS

| | | | |
|---|---|---|---|
| 523843 | 4/1956 | Canada | 104/7.3 |
| 1122989 | 9/1956 | France | 104/7.3 |
| 571197 | 4/1933 | Germany | 104/7.3 |
| 695900 | 8/1953 | United Kingdom | 104/7.3 |

*Primary Examiner*—Robert J. Oberleitner
*Assistant Examiner*—S. Joseph Morano
*Attorney, Agent, or Firm*—Henry M. Feiereisen

[57] ABSTRACT

A mobile working machine for treatment of a ballast bed or subgrade for a track comprised of rails fastened to ties includes a machine frame which is defined by a longitudinal axis and supported by undercarriages for movement in an operating direction along a track, and a track lifting unit which is vertically adjustably mounted to the machine frame between two undercarriages for lifting the track. The track lifting unit includes a load-bearing member which extends perpendicular to the longitudinal axis of the machine frame and has a length exceeding a tie length. The load-bearing member forms with its drives a structural unit, which encircles the track in a direction transversely to the machine frame during operation and is solely supported by the machine frame, and has a rolling element which is rotatable about an axis transverse to the longitudinal axis of the machine frame for providing a support for the ties of the track.

20 Claims, 2 Drawing Sheets

MOBILE WORKING MACHINE FOR TREATMENT OF A BALLAST BED OR SUBGRADE

BACKGROUND OF THE INVENTION

The present invention refers to a mobile working machine for treatment of a ballast bed or subgrade for a track comprised of rails fastened to ties, and in particular to a working machine of the type having a machine frame supported by undercarriages for movement in an operating direction along a track, and a track lifting unit which is vertically adjustably mounted to the machine frame between two undercarriages for lifting the track.

A mobile working machine of this type is known from U.S. Pat. No. 4,479,439 and is used for replacement of a track ballast bed while laying a protective layer for the subgrade at the same time. The machine frame which travels continuously along the track in operating direction is supported at its axial ends by undercarriages and coupled to further freight cars. During travel from site to site, one of the undercarriages of the machine frame is lowered onto the track so as to run securely on the track while the operating range of the vehicle is substantially lengthened at the working site by lifting the undercarriage off the track to thereby effectively increase the length of the construction section. A track lifting unit is arranged approximately central between the terminal undercarriages and is vertically adjustably mounted to the machine frame for lifting the track in order to create beneath the ties sufficient space for track bed working units comprised of an excavating chain for exposing the subgrade as well as a vertically adjustable planing unit for leveling and compacting sand and ballast laid upon the subgrade. The track lifting unit includes laterally pivotal flanged rollers which engage from both sides under the rail head for lifting and continuously holding the railroad track at a desired level. When encountering changes in the rail cross sections, e.g. during travel over of a rail joint, the locking engagement of these flanged rollers with the rail head may be compromised, thus adversely affecting a permanent and secure support of the rail.

U.S. Pat. No. 3,179,062 discloses an under-track device for treating a track bed from beneath a railroad track and includes a frame which advances in wedge-like manner longitudinally in direction of the track. This device is supported via track-type conveyors, which are driven by a hydraulic motor and vertically adjustably mounted with the frame, upon the ballast surface or subgrade surface which is planed by clearing tools located at the forward end of the device. The vertical support and spacing of the railroad track from the ballast bed is attained by two endless tracks which extend longitudinally in direction of the track and are arranged in the area below the rails on the upper side of the frame of the device. These endless tracks press against and run on the bottom of the ties while the device travels through the track bed. Arranged above the device is a vehicle which travels along the track and is equipped with a power source and a control unit and is moved together with the device via a link mounted on the longitudinal side of the machine frame, with the weight of the vehicle being also transmitted via the endless tracks onto the track bed. Such a device requires a very high lifting of the track and thus causes inadmissible flexures of rails in particular when lifting heavy rails.

A similar device for planing a ballast bed surface from beneath a railroad track is described in Canadian patent no. CA 523,843 and includes a carriage-like slide in form of a horizontal plate which is pushed and pulled beneath the ties by a machine running on a track in a wedge-like manner between track and ballast bed. In order to lift the track from the ballast bed, the top of the slide is provided with a large number of rolls which are arranged in two rows and carry two endless chains longitudinally in direction of the track and run in the area beneath the rails upon the tie bottom.

SUMMARY OF THE INVENTION

It is an object of the present invention to provide an improved treatment machine for a ballast bed and subgrade, obviating the afore-stated drawbacks.

It is another object of the present invention to provide an improved working machine for treatment of a ballast bed and subgrade by which the track is securely and reliably lifted regardless of rail irregularities such as e.g. rail joints.

These objects and others which will become apparent hereinafter are attained in accordance with the present invention by providing the track lifting unit with a load-bearing member which extends perpendicularly relative to longitudinal direction of the machine frame and has a length exceeding the tie length, with the load-bearing member forming with its drives a structural unit which encircles the track in a direction transversely to the machine frame during operation and is solely supported by the machine frame and having a rolling element which is rotatable about an axis oriented transversely to the machine frame for support of the ties of the track.

The provision of such a self-contained track lifting unit allows a transfer of track lifting forces from the drives of the track lifting unit onto the tie bottoms without requiring a contact with the rails. Thus, the support of the track is ensured even when the rail cross section changes e.g. across rail joints. Since the track lifting unit is mounted to the machine frame solely via the drives and thus supported only by the machine frame, the level by which the track is raised relative to the ballast bed surface is easily adjustable while still maintaining a stable and secure support of the track during the continuous travel of the machine in operating direction. Moreover, the ballast bed surface beneath the track lifting unit remains unaffected through the suspension of the track lifting unit solely from the machine frame via the drives.

Preferably, the opposing axial ends of the load-bearing member are provided with support arms which are swingably mounted via a joint, which is effective in all directions, to the machine frame and spaced from the drive longitudinally in direction of the track, with at least one of the support arms being acted upon by a swivel drive which is mounted to the machine frame. In this manner, the track lifting unit is stabilized, and the structural unit can be laterally deflected relative to the machine frame in order to be able to follow the track course also during a travel along a curved track without any problems. Suitably, the drives and the support arms are secured detachably to the load-bearing member so that the track lifting unit can be disengaged rapidly and easily, without requiring a severing of a rail track.

According to another feature of the present invention, the rolling element is provided in form of a track chain which runs longitudinally in direction of the track. Preferably, the rolling element includes two such track chains which are spaced from each other in a direction transversely to the machine frame, with each track chain including two deflection rollers which are spaced from each other in longitudinal direction at a distance corresponding to about to tie spacings and each having a diameter equaling about half a tie spacing. In this manner, the railroad track is securely supported regardless of potential irregularities of the bottom of the tie and the required lift of the track can be kept to a minimum so as to avoid inadmissible bending stresses onto the rails.

By articulating the drives and the support arms to the load-bearing member at a location centrally between the two deflection rollers, the rolling element and the track chain can be swung about a horizontal axis so as to best suit possibly uneven tie bottoms.

Suitably, a plurality of rollers is arranged successively in longitudinal direction of the machine frame. Each roller is defined by a horizontal axis which is oriented transversely to the machine frame, with two successive horizontal axes being defined by a distance which is smaller than a tie width. Thus, the rolling element and the entire track lifting unit can be designed in an even flatter configuration while still retaining all advantages as stated above.

Advantageously, the track lifting unit together with the load-bearing member is arranged between two further track lifting units which are spaced from each other in the operating direction and include clamp-like flanged lifting rollers which run on the rail head so that the track can be raised over a long construction site with a particularly soft and material-caring bending line. In immediate area of the top of the tie, the load-bearing member may be provided at operation with guide rollers which are spaced from each other in a direction transversely to the machine frame and rotatable about a vertical axis so as to ensure a self adjustment of the machine in the curved track and to ensure a positioning of the rolling elements under the track relative to the longitudinal direction of the ties.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
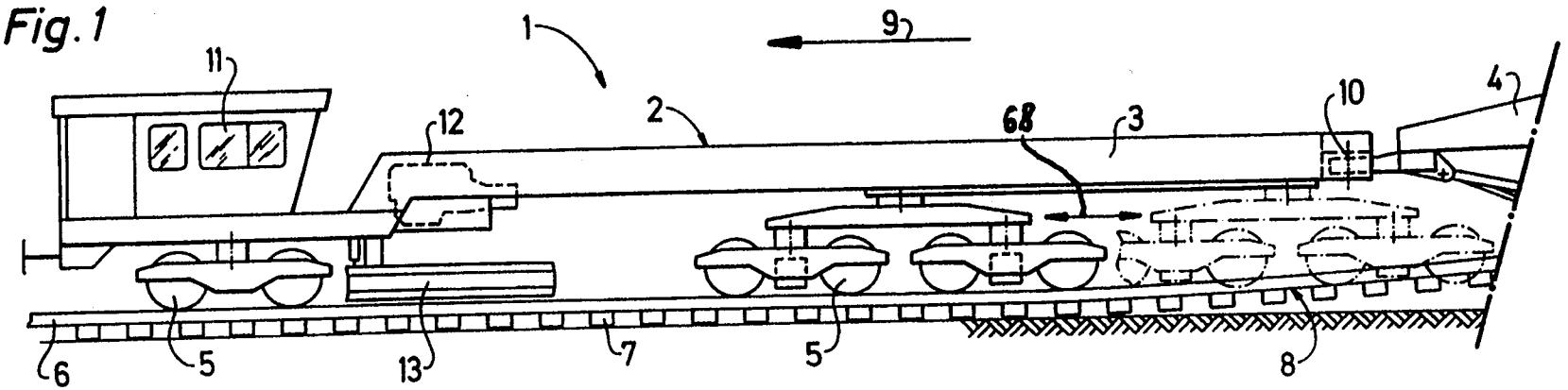
FIG. 1 is a side elevational view of a forward portion of one embodiment of a mobile working machine according to the present invention for treatment of a ballast bed and subgrade.

Throughout all the Figures, the same or corresponding elements are always indicated by the same reference numerals.

Figure 2:
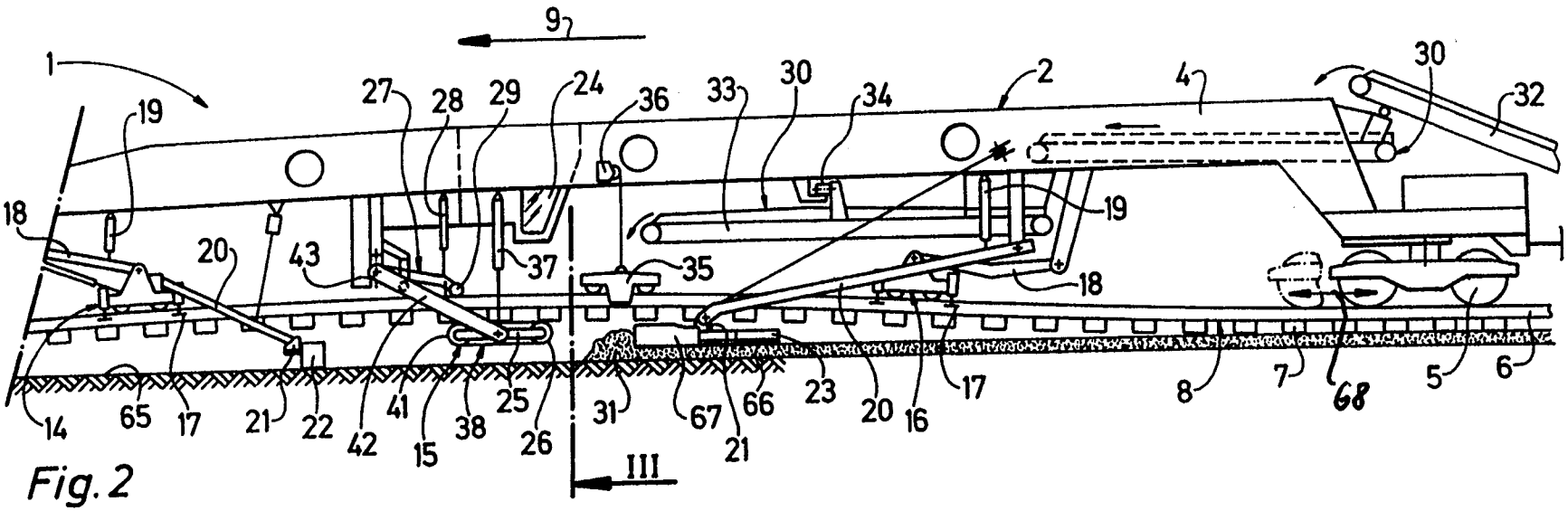
FIG. 2 is a side elevational view of a rearward portion of the working machine of FIG. 1.

Referring now to the drawing, and in particular to FIGS. 1 and 2, there are shown respective side views of a forward portion and a rearward portion of a mobile working machine for treatment of a ballast bed and subgrade, generally designated by reference numeral 1. The working machine 1 includes an elongated machine frame 2 which is supported on a track 8 by a total of three undercarriages 5 for mobility along the track 8 in an operating direction indicated by arrow 9, with the track 8 including rails 6 which are fastened to ties 7. The machine frame 2 comprises two carrier frames 3, 4 which are arranged sequentially in operating direction, with carrier frame 3 forming the leading carrier frame and with carrier frame 4 forming the trailing carrier frame. The carrier frames 3,4 are linked in the area of the central undercarriage 5 by a suitable coupling, schematically indicated by reference numeral 10.

The central undercarriage 5 as well as the trailing undercarriage 5 are shiftable by suitable drives (not shown) in operating direction relative to the machine frame 2, as indicated in dash-dot lines and by double arrow 68. Secured to the forward end of the machine frame 2 is an operator's cab 11, and a central power source 12 is located behind the operators cab 11 for supplying power to all operating drives and working units of the machine 1. A plow arrangement 13 is mounted to the carrier frame 3 of the machine frame 2 immediately behind the foremost or leading undercarriage 5.

As best seen in FIG. 2, the trailing carrier frame 4 of the machine 1 is of bridge-like overhead configuration which projects upwardly and includes three track lifting units 14, 15, 16 which are spaced from each other longitudinally in direction of the track 8. The leading track lifting unit 14 near the central undercarriage 5 and the trailing track lifting unit 16 adjacent the trailing undercarriage 5 are provided in a manner known per se with clamp-like flanged rollers 17 which engage the rails 6 from each side for lifting them and roll on the rail head. Each of the track lifting units 14, 16 is connected via a linkage 18 to the carrier frame 4 and vertically adjustable relative to the carrier frame 4 of the machine frame 2 by a lifting drive 19.

Further provided in the area of the track lifting units 14, 16 are vertically adjustable booms 20 which are mounted to the carrier frame 4 and can be lowered on both longitudinal sides of the track 8. At their free ends, the booms 20 have mountings 21 for optional attachment of ballast treatment tools such as leveling beams 22, distributor beams 67 or compacting units in form of vibratory plates 23. The third central track lifting unit 15 is arranged below an operator's cab 24 which is mounted to the carrier frame 4 of the machine frame 2 and includes a load-bearing member 25 with roller elements 26 for support and placement of the ties 7 of the track 8, as will be described in more detail with reference to FIG. 3.

In the area of the central track lifting unit 15 is a tie stripper unit 27 which is vertically adjustably mounted via a drive 28 to the carrier frame 4 and guided in the lower operating position on the rail 8 by flange rollers 29. A conveyor belt arrangement, generally designated by reference numeral 30 extends from the rear end of the carrier frame 4 to an unloading area 31 which is in viewing range of the operators cab 24 for receiving ballast material from a freight car 32 and supply of ballast material to the track 8. The freight car 32 is suitably coupled to the machine I and is shown in FIG. 2 by way of a conveyor belt only. The conveyor belt arrangement 30 includes two discharge conveyor belts 33 which extend successively in direction of the track 8 at different levels and are horizontally swingably mounted to the carrier frame 4 of the machine frame 2 via bearing rollers 34. Placed beneath the discharge end of the leading conveyor belt 33 is a funnel unit 35 which travels along the track 8 and ensures accurate introduction of discharged material into the spacing between the ties 7 so that material accumulations are prevented. During travel from site to site, the funnel unit 35 is raised by a holding device 36 from the track 8 and suitably held.

Figure 3:
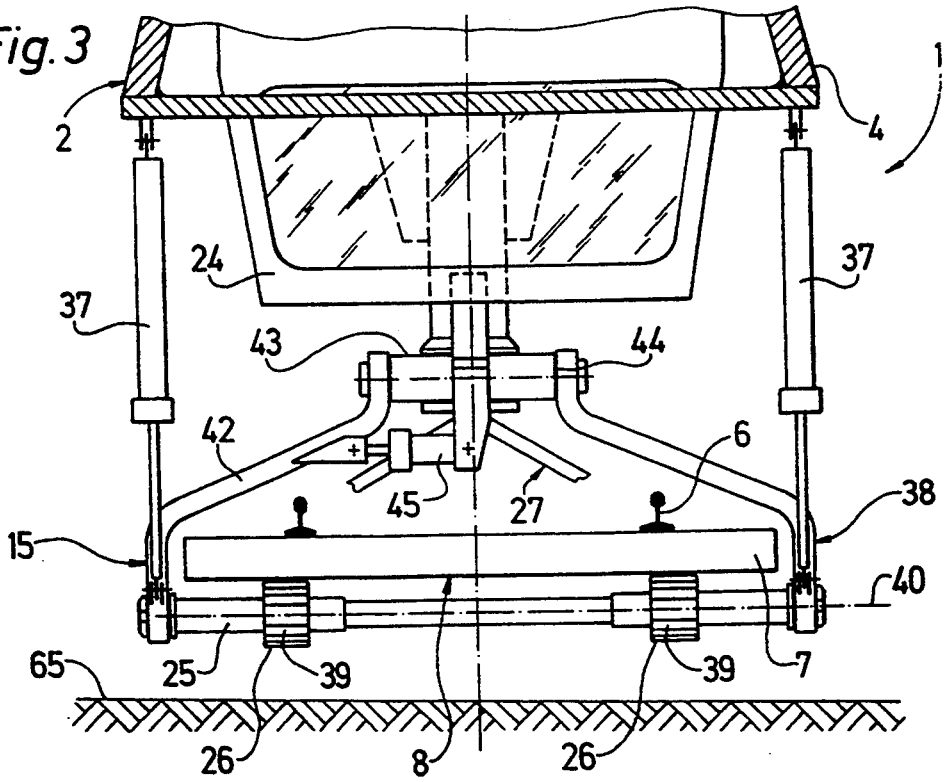
FIG. 3 is an enlarged view of a track lifting unit of the working machine of FIG. 1, taken in direction of arrow III in FIG. 2.

Turning now to FIG. 3, there is shown an enlarged view of the track lifting unit 15, as viewed in direction of arrow III in FIG. 2. The load-bearing member 25 of the track lifting unit 15 extends across the machine frame 2 and parallel to the track plane. The load-bearing member 25 is slightly longer than a tie 7 and is linked at its axial ends to the carrier frame 4 by respective drives 37 e.g. hydraulic or pneumatic drives. The load-bearing member 25 and the drives 37 thus form a self-contained structural unit, generally designated by reference numeral 38, which encircles the track 8 transversely to the machine frame 2 during operation and is solely supported by the carrier frame 4 of the machine frame 2, with the track 8 being lifted by the drives 37.

Underneath the rails 6, the load bearing-member 25 is provided with two rolling elements 26 which are spaced from each other across the machine frame 2 and provided in form of track chains 39 which travel longitudinally in direction of the track 8. As best seen in FIG. 2, each track chain 39 runs about two deflection rollers 41 which rotate about an axis 40 oriented transversely to the machine frame 2 and spaced from each other at a distance corresponding to about two tie spacings. The diameter of the deflection rollers 41 equals about half a tie spacing.

The axial ends of the load-bearing member 25 are connected to S-shaped support or lift arms 42 which are swingably mounted to the machine frame 2 at a common point of articulation to an universal joint 44 which is effective in all directions, with the point of articulation being distanced from the drives 37 in longitudinal direction. A swivel drive 45 is further arranged between one of the support arms 42 and the machine frame 2 and extends perpendicular to the longitudinal direction for pivoting the structural unit 38 about a vertical axis of the joint 44. The drives 37 as well as the support arms 42 are detachably secured to the load-bearing member 25 at a central location thereof, i.e. at a mid-point between the two spaced rollers 41 of a track chain 39.

Figure 4:
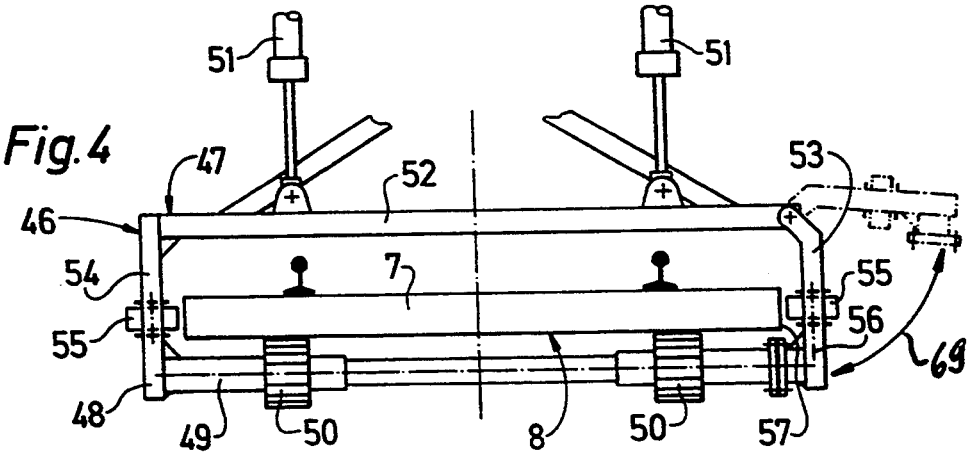
FIG. 4 is a fragmentary view of a modification of a track lifting unit according to the invention.

FIG. 4 illustrates a modification of a track lifting unit, generally designated by reference numeral 46 and including a load-bearing member 47 which is designed in operating position in form of a ring-shaped frame 48 surrounding the track 8. The frame 48 includes a horizontal lower beam 49 which extends transversely across the track 8 and carries spaced rolling elements 50. Extending at a vertical distance parallel to the lower beam 49 is an upper beam 52 which is acted upon by drives 51. The drives 51 are detachably secured to the upper beam 52 for vertical adjustment of the track lifting unit 46. Although not shown in detail in FIG. 4, the other ends of the drives 51 are articulated to the machine frame. The upper and lower beams 52, 49 are connected to each other by vertical side parts 53, 54, with side part 53 being detachably secured to the lower beam 49 and outwardly swingably mounted to the upper beam 52 for pivoting in a direction indicated by double arrow 69. In FIG. 4, the outward positioning of the side part 53 is shown in dash-dot lines. Thus, the track lifting unit 46 can be selectively positioned in an operational position and in an idle position. Both, the side part 53 and the opposite side part 54 of the frame 48 carry guide rollers 55 which rotate about a vertical axis 56 and are disposed near the top of the ties 7 and roll on the tie ends 57.

Figure 5:
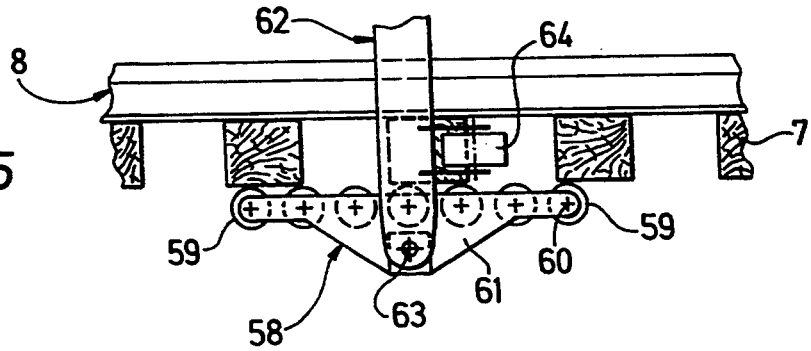
FIG. 5 is a partial side view of still another embodiment of a track lifting unit according to the invention.

FIG. 5 is a partial side view of still another embodiment of a track lifting unit according to the invention, illustrating in detail a rolling element, generally designated by reference numeral 58 and including a plurality of rollers 59 arranged sequentially in longitudinal direction. The rollers 59 are each rotatable about an axis 60 oriented transversely to the longitudinal direction and are mounted on a common bearing block 61. The bearing block 61 is detachably secured to a carriage 62 for rotation about an axis 63 extending transversely to the longitudinal direction. The distance between two neighboring rollers 59 is smaller than the width of one tie 7. At operation, the rollers 59 run on the bottoms of the ties 7. Suitably, the carriage 62 is additionally provided with guide rollers 64 in a manner already described with reference to FIG. 4.

The machine I can be operated in various manner for treatment of a track bed and subgrade. In the embodiment of the machine 1 shown in FIGS. 1 and 2, a protective layer of gravel and sand is laid on the subgrade 65 which is previously freed completely from ballast by a suitable cleaning machine. During this procedure, the plow arrangement 13 is out of operation. The central undercarriage 5 is shifted into its forwardmost position in operating direction, as shown in continuous lines in FIG. 1, while the rear undercarriage 5 is shifted in opposite direction towards the rear, as shown in continuous lines in FIG. 2, so as to increase the length of the construction site for the track 8 being lifted. The track 8 is lifted by the flanged rollers 17 of the track lifting units 14, 16 from the subgrade 65 whereupon the central track lifting unit 15 is readied for operation. The load-bearing member 25 with the rolling elements 26 are placed beneath the ties 7 across the track 8, and then the drives 37 and support arms 42 are attached to both axial ends of the load-bearing member 25. The swivel drive 45 remains temporarily pressureless at this point. Alternatively, the track lifting unit 15 may also be placed at a rail separation point underneath the railroad track so that a disassembly of the structural unit 38 into its individual pads is not required. The track 8 is now supported and secured from below via the track chains 39 of the track lifting unit 15 while the machine 1 travels continuously in direction of arrow 9. The height of the track lift is controlled by the drives 19, 37 and can be best suited to prevailing conditions. The leveling beam 22 smoothens the subgrade 65, and subsequently gravel 66 is discharged by the conveyor belt arrangement 30. Gravel is spread by the distributor beam 67 and compacted by the trailing vibratory plates 23. Thereafter, the trailing track lifting unit 16 lays the track 8 onto the compacted protective layer of the subgrade.

Although not shown in detail, in accordance with a variation of the present invention, a work vehicle travels at the construction site along the lowered track 8 which is laid onto the subgrade 65 or onto the already provided protective layer of the subgrade, with ballast being discharged from a Talbot car for completely filling the railroad track. The subsequent machine 1 now lifts the track 8 again and levels as well as compacts ballast material, previously introduced and spread by the plow arrangement across the railroad track cross, in a manner as described above. It is also possible to supply to the work area in addition to ballast material introduced by the conveyor belt arrangement 30 also material from the rear machine end.

While the invention has been illustrated and described as embodied in a mobile working machine for treatment of a ballast bed or subgrade, it is not intended to be limited to the details shown since various modifications and structural changes may be made without departing in any way from the spirit of the present invention.

What is claimed as new and desired to be protected by Letters Patent is set forth in the appended claims:

1. A working machine for treatment of a ballast bed or subgrade track comprised of rails fastened to ties, comprising:

a machine frame defined by a longitudinal axis and supported by undercarriages for movement in an operating direction along the track; and a track lifting unit vertically adjustably mounted to said machine frame between two said undercarriages for lifting the track, said track lifting unit including a drive means connected to said machine frame for effectuating the vertical adjustment of said track lifting unit and a load-bearing member extending perpendicular to said longitudinal axis of said machine frame and having a length exceeding a tie length, said load-bearing member forming with said drive means a structural unit which encircles the track transversely to said longitudinal axis during operation and is solely supported by said machine frame and having a rolling element which is rotatable about an axis transversely to said longitudinal axis for supporting the ties of the track.

wherein said track lifting unit includes a joint effective in all directions and support arms connected to opposing ends of said load-bearing member which are spaced from each other in a direction transverse to said longitudinal axis, said support arms being swingably mounted about a common point of articulation of said joint to said machine frame, with said point of articulation being spaced from said drive in the direction of said longitudinal axis.

2. The machine of claim 1 wherein said track lifting unit includes a swivel drive articulated to said machine frame and connected to at least one of said support arms.

3. The machine of claim 1 wherein said drive means and said support arms are detachably secured to said load-bearing member.

4. The machine of claim 1 wherein said rolling element is provided in the form of at least one track chain running in the direction of said longitudinal axis.

5. The machine of claim 1 wherein said rolling element is provided in the form of two track chains spaced from each other in a direction transversely to said longitudinal axis, with each track chain running about two deflection rollers spaced from each other in the direction of said longitudinal axis by a distance corresponding to about two tie spacings.

6. The machine of claim 5 wherein said deflection rollers have a diameter equaling about half a tie spacing.

7. The machine of claim 1 wherein said rolling element is provided in the form of a track chain running about two deflection rollers spaced from each other in direction of said longitudinal axis, said drive and said support arms being articulated to said load-bearing member at a central location between said two deflection rollers.

8. The machine of claim 1 wherein said rolling element includes a plurality of rollers arranged successively in the direction of said longitudinal axis, each of said rollers having a horizontal axis oriented transversely to said longitudinal axis wherein two successive horizontal axes are defined by a distance which is smaller than a tie width.

9. The machine of claim 1, and further comprising two additional track lifting units spaced from of each other in the direction of said longitudinal axis and each being provided with clamp-like lifting rollers running on the rail head, said track lifting unit being arranged between said additional track lifting units.

10. The machine of claim 1 wherein said load-bearing member is provided with guide rollers which are spaced from each other in a direction transversely to said longitudinal axis and rotatable about a vertical axis, said guide rollers extending at operation near the top of the tie.

11. A track lifting unit for use in a working machine for treatment of a ballast bed or subgrade for a track, comprising:

a load-bearing member extending across the track at a length exceeding the tie length and having a rolling element for supporting the ties of the track; and drive means connecting said load-bearing member to the working machine for moving said load-bearing member relative to the track, said load-bearing member forming with said drive means a self-contained structural unit which encircles the track transversely to said longitudinal axis during operation and is solely supported by the working machine, wherein said drive means includes a first drive for vertically adjusting said load-bearing member about a horizontal axis, said drive having one end connected to said load-bearing member at a point of connection and another end articulated to the working machine, a joint secured to the working machine, and support arms having one end connected to said load-bearing member and another end swingably mounted about said joint at a point of articulation which extends at a distance to said point of connection.

12. The track lifting unit of claim 11 wherein said drive means includes a second drive connected to the working machine and acting upon at least one of said support arms for adjusting said load bearing member about a vertical axis.

13. The track lifting unit of claim 11 wherein said roller means is a track chain.

14. The track lifting unit of claim 13 wherein said track chain runs about two deflection rollers spaced from each other longitudinally in direction of the track by a distance corresponding to about two tie spacings.

15. The track lifting unit of claim 14 wherein said deflection rollers have a diameter equaling about half a tie spacing.

16. The track lifting unit of claim 11 wherein said rolling element is a track chain guided about two spaced deflection rollers, said first drive and said support arms being articulated to said load-bearing member at a central location between said two deflection rollers.

17. The track lifting unit of claim 11 wherein said rolling element includes a plurality of rollers successively arranged longitudinally in direction of the track, each of said rollers having a horizontal axis oriented transversely to the longitudinal direction, wherein two successive horizontal axes are defined by a distance which is smaller than a tie width.

18. The track lifting unit of claim 11 wherein said load-bearing member is provided with guide rollers which are spaced from each other in a direction transversely to the longitudinal direction and rotatable about a vertical axis, said guide rollers extending at operation near the top of the tie.

19. A working machine for treatment of a ballast bed or subgrade for a track comprised of rails fastened to ties, comprising:

a machine frame defined by a longitudinal axis and supported by undercarriages for movement in an operating direction along the track; and a track lifting unit vertically adjustably mounted to said machine frame between two said undercarriages for lifting the track, said track lifting unit including a drive means connected to said machine frame for effectuating the vertical adjustment of said track lifting unit and a load-bearing member extending perpendicular to said longitudinal axis of said machine frame and having a length exceeding a tie length, said load-bearing member forming with said drive means a structural unit which encircles the track transversely to said longitudinal axis during operation and is solely supported by said machine frame and having a rolling element which is rotatable about an axis transversely to said longitudinal axis for supporting the ties of the track, wherein said load-bearing member is provided with guide rollers which are spaced from each other in a direction transversely to said longitudinal axis and rotatable about a vertical axis, said guide rollers extending at operation near the top of the tie.

20. A track lifting unit for use in a working machine for treatment of a ballast bed or subgrade for a track, comprising:

a load-bearing member extending across the track at a length exceeding the tie length and having a rolling element for supporting the ties of the track; and drive means connecting said load-bearing member to the working machine for moving said load-bearing member relative to the track, said load-bearing member forming with said drive means a self-contained structural unit which encircles the track transversely to said longitudinal axis during operation and is solely supported by the working machine, wherein said load-bearing member is provided with guide rollers which are spaced from each other in a direction transversely to the longitudinal direction and rotatable about a vertical axis, said guide rollers extending at operation near the top of the tie.

* * * * *

UNITED STATES PATENT AND TRADEMARK OFFICE

CERTIFICATE OF CORRECTION

PATENT NO. : 5,435,252

DATED : July 25, 1995

INVENTOR(S) : Josef Theurer & Manfred Brunninger

It is certified that error appears in the above-identified patent and that said Letters Patent is hereby corrected as shown below:

ON THE TITLE PAGE:

[73] Assignee: delete "die Firma".

Signed and Sealed this

Seventeenth Day of October, 1995

*Attest:*

Bruce Lehman

BRUCE LEHMAN

*Attesting Officer*

*Commissioner of Patents and Trademarks*